United States Patent [19]

Chang

[11] Patent Number: 4,643,452

[45] Date of Patent: Feb. 17, 1987

[54] BUSINESS CARD ATTACHING STRIP

[76] Inventor: Kwei K. Chang, 20530 Anza Ave., Torrance Venture, Apt. 112, Torrance, Calif. 90503

[21] Appl. No.: 765,650

[22] Filed: Aug. 15, 1985

[51] Int. Cl.[4] ..... B42D 15/00; B42F 3/00; B42F 13/00

[52] U.S. Cl. ..... 283/62; 402/79; 402/500

[58] Field of Search ..... 283/36, 37, 39, 41, 283/61, 62; 282/1 A, 2, 3 A, 13 R, 12 R; 402/79, 500; 40/402, 403, 535, 536

[56] References Cited

U.S. PATENT DOCUMENTS 1,769,395 7/1930 Selden ..... 402/79
2,962,335 11/1960 Benson ..... 402/500
4,009,784 3/1977 Ellas ..... 402/500
4,430,015 2/1984 Nerlinger ..... 402/500

*Primary Examiner*—Paul A. Bell
*Assistant Examiner*—Paul M. Heyrana, Sr.
*Attorney, Agent, or Firm*—William M. Hobby, III

[57] ABSTRACT

An elongated strip of sheet material is adapted to be attached along the bottom edge of a business card to convert the card to an index card suitable for filing in a card file, such as a rolodex, without having to punch holes in the business card. The elongated strip of sheet material has predetermined openings along one edge for attachment to a card file and an adhesive coating along the opposite edge thereof for attachment to the business card. A strip of adhesive covering material covers the adhesive.

2 Claims, 4 Drawing Figures

BUSINESS CARD ATTACHING STRIP

BACKGROUND OF THE INVENTION

The present invention relates to a system for converting a business card into an index card for insertion into a card file such as a rolodex without having to punch holes in the business card.

There are known perforated filing strips which are used to enable non-perforated documents, catalogs, folded drawings or the like to be filed in files or binders having ring, tongue, or pin fasteners without having to punch holes in the documents. Specifically, these filing strips consist of a cardboard or plastic strip of a length equal to or shorter than that of the edge of the document to be filed. One such filing strip consists of plastic material with a self-adhesive coating along its inner edge, a plurality of perforations disposed along its outer edge, and a fold between the two edges such that the outer part is adapted to be folded back over the document which is attached. The prior art filing strips however, do not incorporate the special shape and special edge openings converting a business card into an index card nor do they have special openings to permit converted business cards to be inserted in a card index such as a rolodex.

The present invention deals with an attaching strip for quickly attaching to a business card. The strip has special edge openings along its outer edge for inserting the business card in a card index file, such as a rolodex. The inner edge of elongated strip has a self-adhesive band covered with a wax paper or the like to protect the adhesive band. The outer edge of the strip has a pair of edge openings in a spaced relationship to each other, each having an enlarged aperture with a narrowed opening to the outer edge.

SUMMARY OF THE INVENTION

The present invention relates to a filing strip attachment which includes an elongated strip of sheet material having predetermined holes therein positioned for attaching to a card index file for the purpose of converting a business card into an index card. The elongated strip of material has an adhesive band along its inner edge and a strip of adhesive covering material covering the adhesive band whereby the adhesive covering can be removed when attaching the strip to a business card. The covering material protecting the adhesive band can be wax paper. The outer edge of the filing strip has predetermined shaped edge openings therein positioned and shaped for attaching to a card index. It also has an elongated visible line parallel to the adhesive band, for proper alignment of a business card so that the length of the and is parallel to the length of the strip.

DESCRIPTION OF PREFERRED EMBODIMENTS

Figure 1:
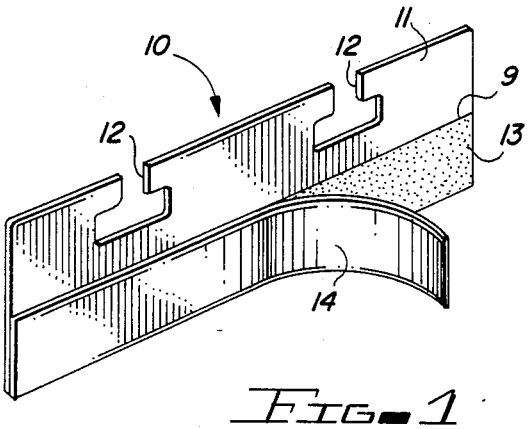
FIG. 1 is a perspective view of a business card filing strip in accordance with the present invention, having a piece of the adhesive covering material pulled back.
Figure 2:
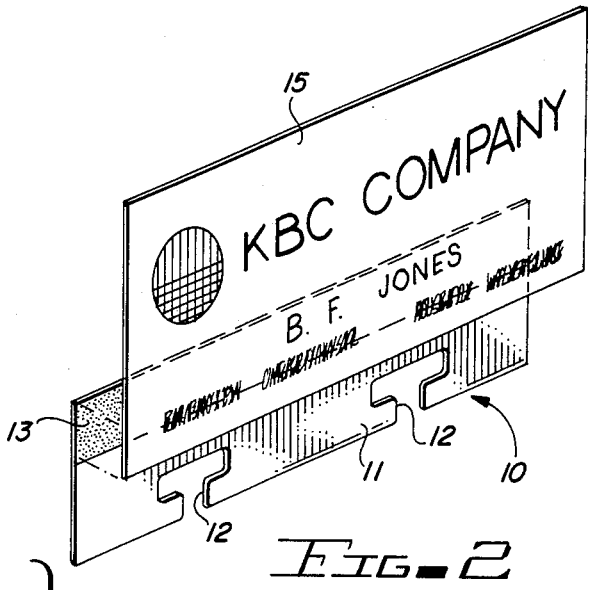
FIG. 2 is an elevational view of the back side of a business card having the filing strip of FIG. 1 attached thereto.
Figure 3:
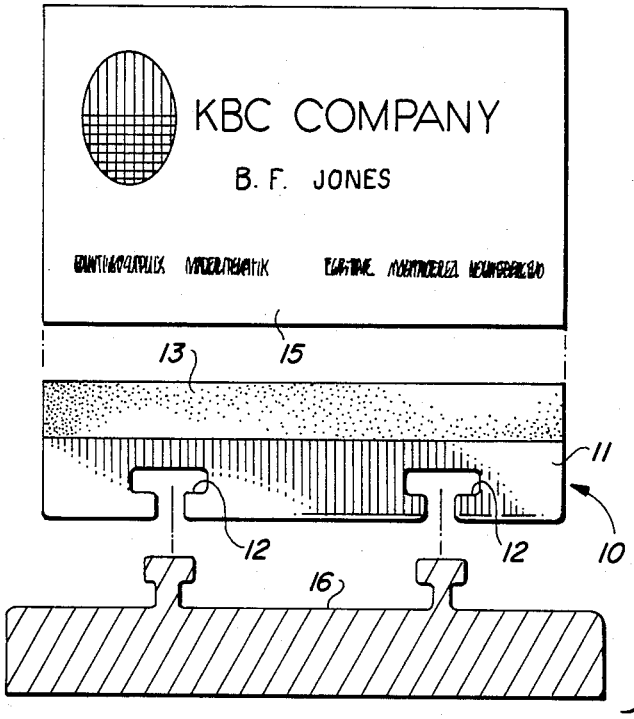
FIG. 3 is an exploded view of a business card, business card filing strip and business card index file.
Figure 4:
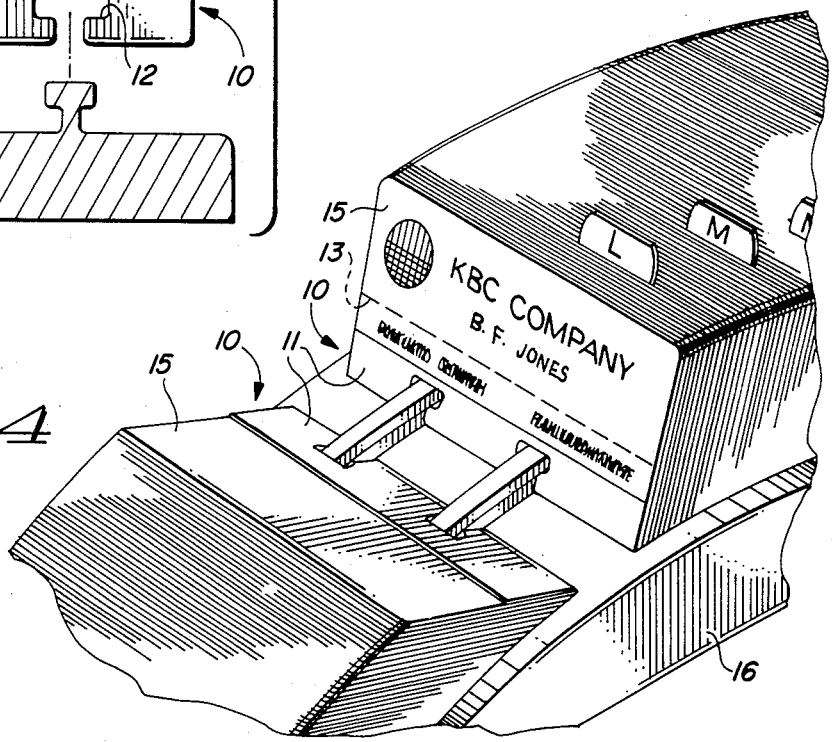
FIG. 4 is a perspective view of a card index file with business cards, with attaching strips inserted therein.

Referring to FIGS. 1 thru 4 of the drawings, a transparent polymer strip 11 having two specially punched holes 12, therein, an adhesive coating 13 covered with a covering material, waxed paper or the like, 14. The edge of the adhesive coating is marked by a line 9 which line assists in aligning the business card being attached to the strip 10. Covering 14 has been removed in FIG. 2 and a business card 15 has been attached to the adhesive coating 13 along the line 9 to convert the business card 15 into an index card. Since the strip of material 11 is a transparent polymer, the printed material on the business card 15 is not interfered with. The strip of adhesive 13 surface is attached to the back of the business card 15 so that the front of the business card will have nothing attached thereto. In FIG. 3, the business card 15 has two holes 12 punched in predetermined position and a predetermined shapes to fit into the business card index 16 which can be any of several standard existing card holders. FIG. 4 shows a business card 15 with the strip 11 attached inserted in a holder for index cards 16.

I claim:

1. A business card attaching strip comprising in combination:

an elongated strip of material sized to fit a business card, said elongated strip of material having a plurality of predetermined shaped edge openings including a pair of edge openings in a spaced relationship to each other, each having an enlarged aperture with a narrowed openings to one edge of said elongated strip of material and shaped for attaching to a card index;

said elongated strip of material having an adhesive coating thereon along one edge thereof and a strip of adhesive coating material covering said adhesive on said elongated strip of material, whereby said adhesive covering material can be removed and said elongated strip of material attached to a card index; and said elongated strip of material having an elongated visible line thereon parallel to said adhesive covering strip.

2. A business card attaching strip in accordance with claim 1, in which said strip of adhesive covering material is an elongated strip of wax paper covering said adhesive coating surface.

* * * * *